US005305892A

United States Patent [19]

Kronseder

[11] Patent Number: 5,305,892

[45] Date of Patent: Apr. 26, 1994

[54] PROCESS AND DEVICE FOR THE SORTING OF BOTTLES

[76] Inventor: Hermann Kronseder, Regensburger Strasse 42, 8404 Woerth/Donau, Fed. Rep. of Germany

[21] Appl. No.: 45,225

[22] Filed: Apr. 13, 1993

[30] Foreign Application Priority Data

Apr. 15, 1992 [DE] Fed. Rep. of Germany ..... 4212535

[51] Int. Cl.[5] ..... B07C 5/00

[52] U.S. Cl. ..... 209/523; 209/552

[58] Field of Search ..... 209/529, 525, 526, 528, 209/577, 578, 587, 597, 598, 605, 599, 522, 523, 524, 909, 552; 198/465.2

[56] References Cited

U.S. PATENT DOCUMENTS

| | | | |
|---|---|---|---|
| 3,484,685 | 12/1969 | Murley, Jr. | 209/529 X |
| 3,771,649 | 11/1973 | Strauss | 209/599 X |
| 4,029,961 | 6/1977 | Lohr et al. | 198/465.2 X |
| 4,040,533 | 8/1977 | DeBoer et al. | 198/465.2 X |
| 4,244,458 | 1/1981 | Kampf | 198/346.2 |
| 4,356,909 | 11/1982 | November et al. | 198/465.2 |
| 5,248,045 | 9/1993 | Alveda | 209/552 |

FOREIGN PATENT DOCUMENTS

| | | |
|---|---|---|
| 2534183 | 2/1977 | Fed. Rep. of Germany . |
| 2921640 | 12/1980 | Fed. Rep. of Germany . |

*Primary Examiner*—D. Glenn Dayoan
*Attorney, Agent, or Firm*—Finnegan, Henderson, Farabow, Garrett & Dunner

[57] ABSTRACT

A process and a device for the sorting of bottles, in which unsorted bottles received in crates and identified according to type are removed from the crates at least partly and are then inserted again into different crates according to type without intermediate storage. Due to this, crates with only one type of bottles can be produced in a small space with low cost expenditure and smooth-running bottle transport.

23 Claims, 4 Drawing Sheets

PROCESS AND DEVICE FOR THE SORTING OF BOTTLES

BACKGROUND OF THE INVENTION

The invention relates to a process and a device for the sorting of bottles being received unsorted in crates.

It is already known to jointly remove bottles belonging to a specific type by means of an unpacking means with individually controllable gripping bells and to deposit them on a multi-track conveyor (DE-OS 25 34 183). The removed bottles are taken away by the conveyor and temporarily stored until a sufficiently great number is available, which is then inserted again into crates by means of a specific packing means. In this fashion, crates with only one type can be obtained or a bottle filling system can be fed with bottle material of only one type. However, the great machine expenditure and the large space requirements are disadvantageous, since a specific intermediate or storage conveyor and a specific packing means are required for each bottle type to be removed. In addition to this, there is the risk of disturbances due to bottles having tipped over or being jammed in the area of the intermediate conveyor, at whose end the bottles must again be sorted again into lanes so that they can be properly gripped by the gripping bells of the packing means.

The same applies mutatis mutandis to another known process and the associated device, in which, first of all, all bottles are removed from the crates in unsorted fashion by an unpacking means, reorganized to an individual rapid-speed row, checked and sorted, slowed down, stored separately and finally inserted again into crates by means of a packing means (DE-OS 29 21 640).

This invention is based on the object of providing a process and a device for the sorting of bottles with which crates with only one type can be obtained with small space and cost expenditure and smooth-running bottle transport.

SUMMARY OF THE INVENTION

This object is attained according to the invention by providing a method for sorting bottles of different types stored unsorted in crates, said method comprising delivering crates containing unsorted bottles to a sorting station, at least partially removing the bottles from a crate at said sorting station and identifying each of said bottles while removed therefrom according to type and transferring at least one identified type of bottle out of the crate at the sorting station to at least one other crate without intermediate storage.

The invention also provides an apparatus for sorting bottles of different types stored unsorted in crates comprising delivery means for delivering crates containing unsorted bottles to a sorting station, means for at least partially removing the bottles from a crate at said sorting station and identifying each of said bottles while removed therefrom according to type and transfer means for directly transferring at least one identified type of bottle out of said crate at the sorting station to at least one other crate at a receiving station.

Thus, any expenditure for the intermediate storage of the bottles is avoided in the process and apparatus according to the invention, and the risk of disturbances in the area of the transport of the removed bottles is decisively reduced. An extremely compact and cost-efficient device can be provided which can be advantageously used at the most different locations, starting from the incoming warehouse or the filling system of the beverage industry up to central collection points for returnable bottles.

A process, in which each bottle to be removed is only gripped and deposited once is especially advantageous so that the risk of disturbances is small and the performance is great due to the short distances encountered.

BRIEF DESCRIPTION OF THE DRAWINGS

Two examples of embodiment of the invention are explained in the following by means of the drawings.

DETAILED DESCRIPTION OF THE INVENTION

Figure 1:
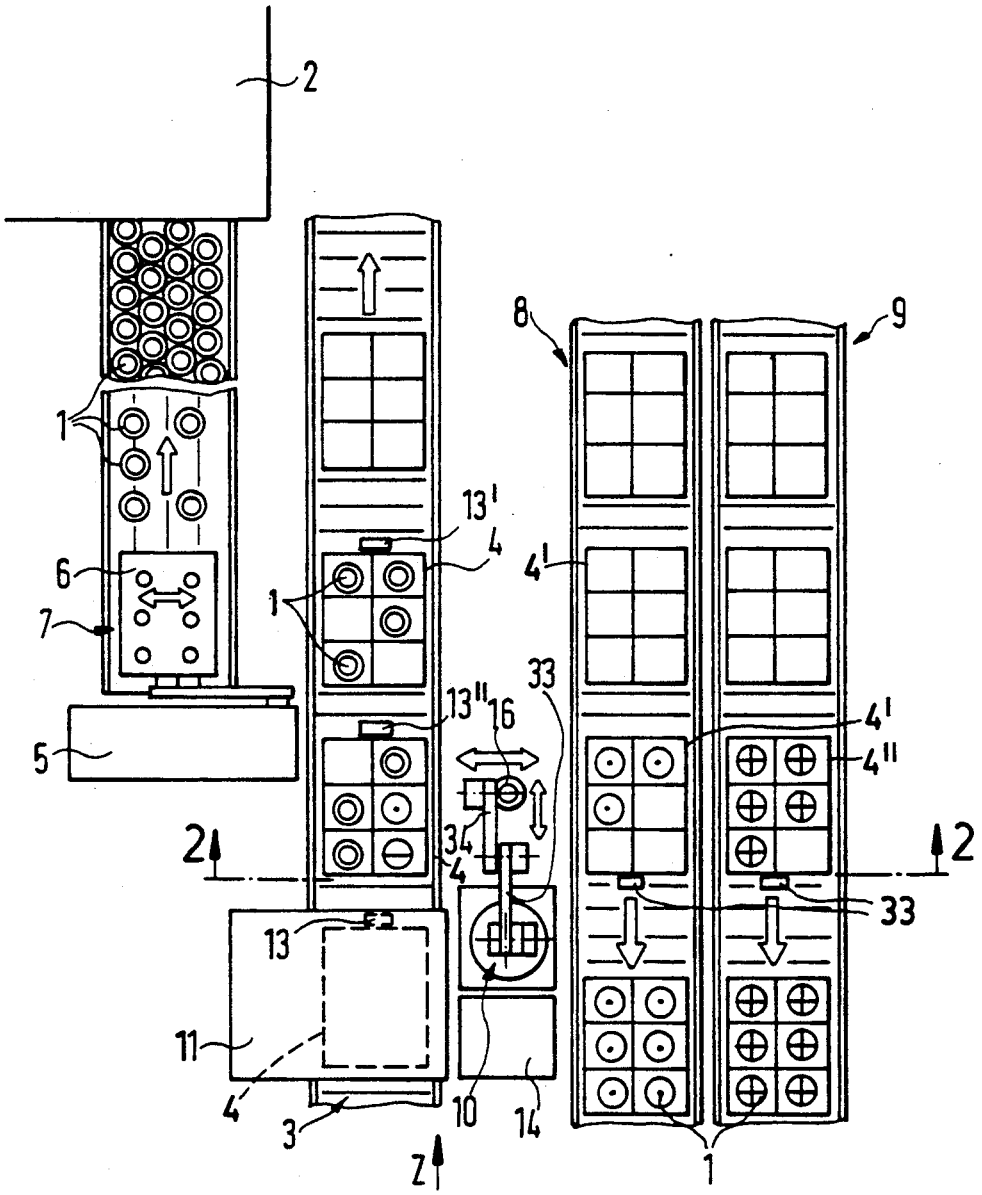
FIG. 1 is a schematic top view of a sorting system for bottles in a filling system.
Figure 3:
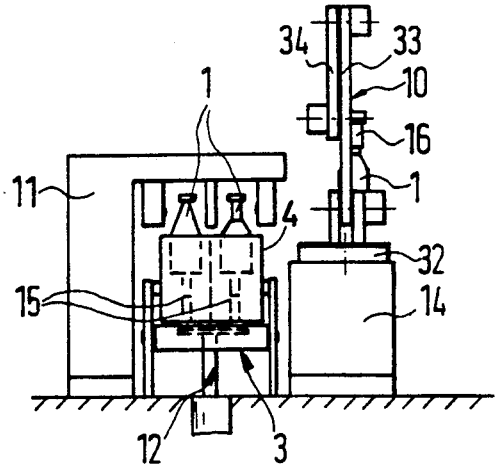
FIG. 3 is a partial view looking in the direction Z in FIG. 1.
Figure 2:
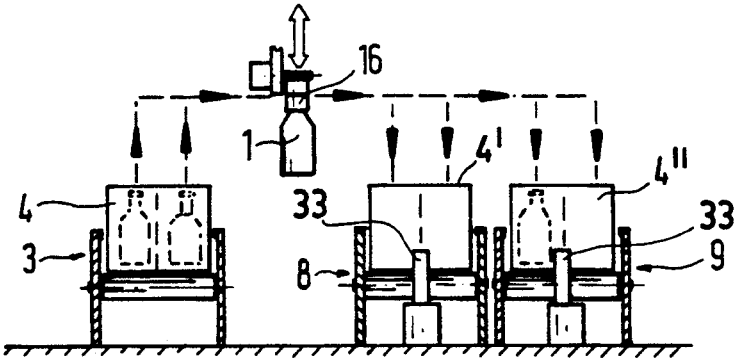
FIG. 2 is a sectional view taken along the line 2—2 in FIG. 1.

The sorting system according to FIGS. 1 to 3 is integrated in an only partially represented filling system equipped for the processing of returnable bottles 1 including the feeding of bottles of only one type to a washing machine 2. It comprises a first conveyor 3 in form a depalletizer (not shown) which are filled with unsorted bottles 1. Three different types of bottles are shown marked with a circle, a dot and a cross. The bottle type marked with a circle is to be filled, whereas the other two types marked with a dot and a cross are to be excluded from the filling process.

An unpacking means 5 with a gripping head 6 movable to and fro, as shown by the arrow in FIG. 1 and comprising several, jointly controllable gripping bells is disposed in accordance with the arrangement of a bottles 1 in the crate 4, which takes all of the bottles 1 still located in the crate 4 out of the crate and deposits them on a second conveyor 7 disposed in parallel to the first conveyor, which is formed by several parallel flat-top chains. The bottles of the type marked with a circle are directly supplied to the washing machine 2 by the second conveyor 7.

A third conveyor 8 and a fourth conveyor 9, in each case in the form of roller conveyors, are disposed in parallel to the first conveyor 3 at the other side. The third and the fourth conveyors 8, 9 are in each case controllably drivable in the same direction, oppositely to the joint direction of conveyance of the first and second conveyors 3, 7. The first and second conveyors 3, 7 and the third and fourth conveyors 8, 9 are in each case located close to each other, whereas there is a greater distance between the first conveyor 3 and the third conveyor 8. A handling robot 10, called robot for short in the following, is disposed in the space between, whose structure and function will be explained in the following. The third conveyor 8 is fed automatically or manually with empty crates for the bottle type marked with a dot and the fourth conveyor 9 is correspondingly fed with empty crates for the bottle type marked with a cross. Thus similar or different crates 4' allocated to the respective bottle type can be used on conveyors 8 and 9, which are fed into the working range of the robot 10.

A test or inspection device 11 for the bottles 1 is disposed at or above the first conveyor 3 before the unpacking means 5, as seen in the direction of transport of the bottles to be processed. A lifting means 12 is provided directly below the test device 11 by means of which the bottles 1 in a crate 4 located directly below the test device 11 can be partially lifted out of the crate, e.g. by means of rods movable through openings in the bottom of a crate (cf. FIG. 3). The contour of the bottles 1 in the neck and opening portions 15 are checked in the lifted position by means of optoelectronic sensors or cameras, and the bottles 1 are allocated to one of the three bottle types, possibly by means of colour sensors. After the testing procedure, the bottles 1 are again lowered by the lifting means 12 and are further transported in the lowered position in the crate 4. Positioning of the crate 4 in the test device 11 is effected by means of a stop 13 for the front crate wall, which is movable upwards in controlled fashion between the rollers of the first conveyor 3. Corresponding controllable stops 13' and 13" also fix the crates 4 in the area of the unpacking means 5 and in the area of the robot 10, respectively.

Signals from the test device 11, which tests all bottles 1 in a crate at the same time, are input into a computer means 14 which controls robot 10, the stops 13, 13' and 13", the lifting means 12 and the first, third and fourth conveyors 3, 8, 9. The computer 14 is programmed in such fashion that the following process sequence results:

Each crate 4 with unsorted bottles 1 fed by the first conveyor 3 is first halted at the test device 11 by means of stop 13. The test device detects to which of the three decisive types each bottle 1 belongs and signals the corresponding occupancy of that bottle in the crate 4 to the computer 14, where this occupancy state is temporarily stored. Thereafter, the crate 4 just tested is further transported by somewhat more than a crate length past the stop 13 and stopped in an unloading position in the working area of the robot 10 by means of stop 13".

The robot 10 comprises a rotor 32 rotatable about a vertical axis and articulated arms 33, 34 rotatable about horizontal axes, a controllable gripping bell 16 for a bottle head being linked pivotably about a horizontal axis at the free end of the second articulated arm. The gripping bell 16, maintaining its vertical position, can carry out any desired movement from one crate 4' and 14" being in the unloading position on the first conveyor 3 to two crates 4 in loading positions at the same level on the third conveyor 8 and the fourth conveyor 9 which are fixed by stops 33.

The bottles 1 of the type marked with a dot are gripped individually one after the other by the gripping bell 16 of the robot 10, which is controlled by the computer 14, in the crate 4 fixed in the unloading position, are lifted, moved laterally over a crate 4' fixed in the loading position on the third conveyor 8, are downwardly inserted into the same and released. The corresponding movement path of the gripping head 16 is outlined in dash-dotted fashion in FIG. 2. It can be well recognized that each bottle 1 is transferred directly from crate to crate without being intermediately deposited after a short distance.

The crates 4' on the third conveyor 8, which are at first empty, are thus gradually filled with bottles 1 of the type marked with a dot in the predetermined order until they are full. Thereafter, a new, empty crate 4' is transported into the loading position and fixed by controlling the corresponding stop 33 and the third conveyor 8.

The corresponding control is possible in simple fashion by the computer 14, which proceeds from the assumption that each new crate 4' on the third conveyor 8 is at first completely empty. It is also possible to dispose sensors (not shown) below the third conveyor 8 in the loading position in accordance with the bottle arrangement, which signal to the computer 14 whether the one or the other receptacle of the crate 4' is already occupied by a bottle 1. In this case, crates 4' already partially filled with bottles 1 of the corresponding type can be loaded without a double occupancy of a receptacle taking place.

After all bottles of the type marked with a dot have been removed and again inserted into the allocated crates 4' the removal and re-insertion of the bottles 1 of the type marked with a cross in a crate 4' takes place in the same fashion, which is fixed on the fourth conveyor 9 by a further corresponding stop 33 in the loading position. The corresponding movement path of the gripping bell 16 is indicated in dash-dotted fashion in FIG. 2. Here, as well, the removal and insertion of the respective bottles 1 is carried out directly.

After all "wrong-type bottles" have been removed in this fashion from the crate 4 in the unloading position, it only contains bottles 1 of the type marked with a circle. The crate 4 prepared in this fashion is further transported by somewhat more than a crate length by the first conveyor 3 after having been released by the corresponding stop 13" and is fixed in the unloading position by another stop 13'. All bottles 1 still located in the crate 4 are removed in conventional fashion by the gripping head 6 of the unpacking means 5 in this position and deposited on the second conveyor 7. The same introduces the bottles 1 into the filling system where they are first of all cleaned in the washing machine 2, then filled, closed, labelled, etc.

In order to increase the output, two robots 10 can also be used in the system according to FIGS. 1 to 3, each of which being allocated to a special bottle type. These two robots can remove their bottle type from a crate 4 at the same time or successively and insert them into another crate. It is also possible to remove the bottles 1 of the type marked with a circle, which were recognized by the test device 11, first off all by means of the unpacking means 5. In this case, the gripping bells (not shown) of the gripping head 6 must be individually controllable by means of the computer 14, and the unloading position of the crates 4 is disposed behind the unpacking position, seen in the transport direction. If an intermediate storage possibility for several crates 4 filled with wrong-type bottles is created between the two positions, the clock time for the unpacking means 5 can be shortened and its output can thus be increased, since the removal times for the wrong-type bottles can be balanced over a longer period of time.

Figure 4:
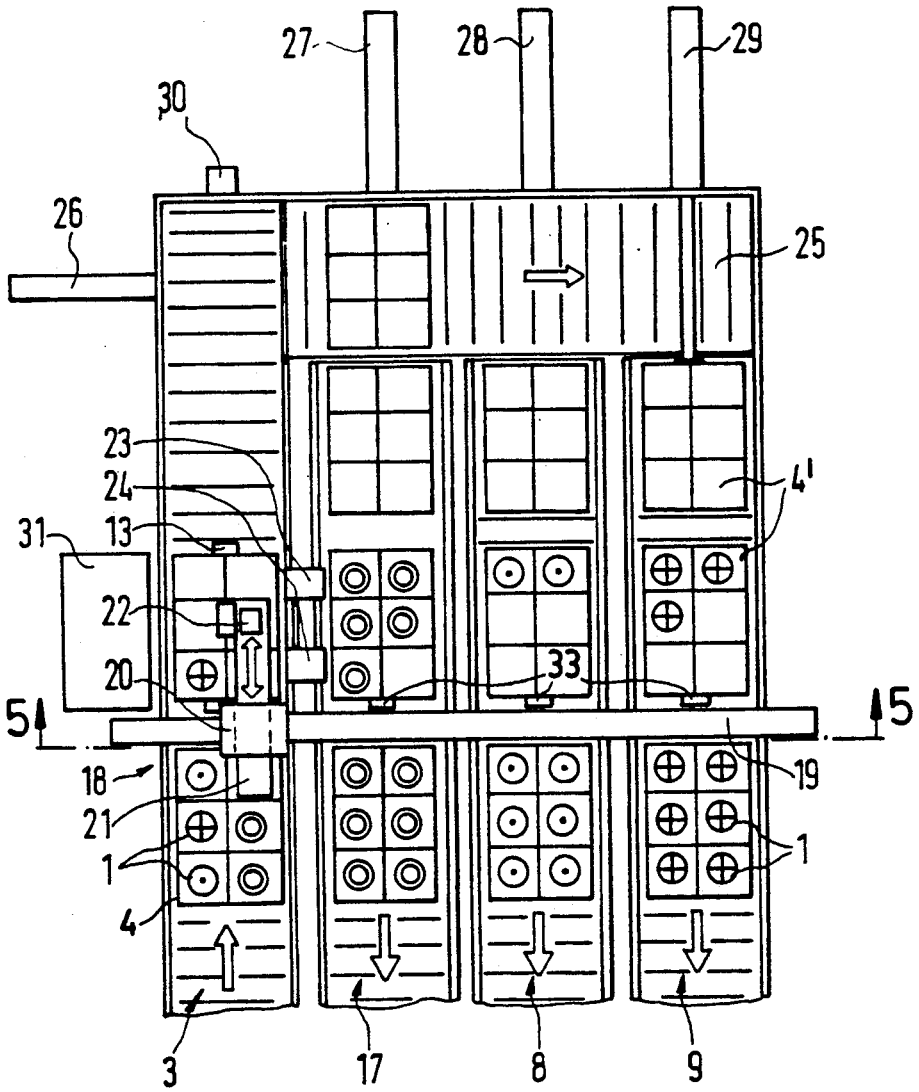
FIG. 4 is a schematic top view of another sorting system at a bottle collection point.
Figure 5:
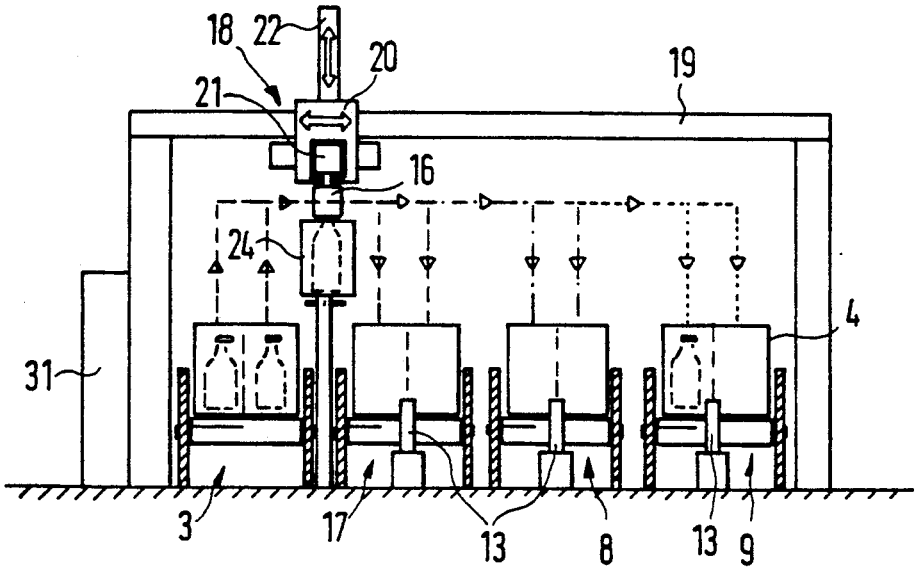
FIG. 5 is a sectional view taken along the line 5—5 in FIG. 4.

The sorting system according to FIGS. 4 and 5 is integrated in an only partially represented collection point for returnable bottle 1 and is designed to process three different types of bottles, which, in turn, are marked by a circle, a dot or a cross. Crates 4' with only one type of bottles are to be formed with the bottles 1 delivered in unsorted fashion in crates 4.

Accordingly, the system according to FIGS. 4 and 5 comprises, in similar fashion as the system according to FIGS. 1 to 3, a first conveyor 3 in the form of a roller conveyor for the crates 4 with the unsorted bottles 1. In parallel to it, a second conveyor 17 is provided for the bottles marked with a circle, a third conveyor 8 for the bottles marked with a dot and a fourth conveyor 9 for the bottle type marked with a cross. The second, third and fourth conveyors 17, 8, 19 are also formed by roller conveyors and can be driven in the same direction, namely oppositely to the first conveyor 3.

An overhead handling robot 18, called robot in the following, is disposed above the four conveyors 3, 17, 8 and 9. A horizontally movable traveller 20 with an also horizontally movable telescopic arm 21 is mounted on the horizontal support 19 of the robot 18, at whose free end a vertical lifting arm 22 with a controllable gripping bell 16 is disposed. The length of the support 19, of the telescopic arm 21 and of the lifting arm 22 is dimensioned in such fashion that the gripping bell 16 can completely cover the entire area of four crates fixed on the four conveyors in a side-by-side relationship in an unloading or a loading position. The fixing of the crates 4, 4' in their respective positions is effected in similar fashion as in the system according to FIGS. 1 to 3, again by controllable, liftable and lowerable stops 13, 33 for the front crate wall. The control of the three motors for the slide 20, for the telescopic arm 21 and for the lifting arm 22 and for the gripping bell 16 is effected by means of a computer 31, which also controls the stops 13, 33 and the four conveyors 3, 17, 8 and 9.

An illumination means 23 and a camera 24 are disposed on stands or bridges in the space between the first conveyor 3 and the second conveyor 17 over the movement path of the crates in such fashion that a bottle 1 can pass between them. The camera 24 scans the bottles 1 guided linearly past the camera by the gripping bell 16 with respect to their allocation to one of the three bottle types and inputs corresponding signals into the computer 31. The computer 31 is programmed in such fashion that the following process sequence results:

Each crate 4 with unsorted bottles 1 which is fed by the first conveyor 3 is fixed by means of a stop 13 in the unloading position below the robot 18. Thereafter, the gripping bell 16 grips the defined first bottle 1, lifts it out of the crate 4 and guides it in horizontal direction between the illumination means 23 and the camera 24. During this, the bottle 1 is checked with respect to its type allocation. Bottles 1 of the type marked with a circle are subsequently lowered into a crate 4' on the second conveyor 17 on the movement path outlined in dash-dotted fashion. Bottles of the type marked with a dot are inserted in similar fashion on the movement path drawn in dash-dotted fashion into a crate 4' on the third conveyor 8 and bottles 1 of the type marked with a cross are correspondingly inserted into a crate 4' on the fourth conveyor 9 on the movement path drawn in dotted fashion, in each case without being intermediately deposited or held.

In this fashion, all bottles 1 are removed one after the other from the crate 4 in the unloading position according to a predetermined order and inserted individually one after the other into the crates 4' which are in the loading position. The computer "knows" at any time how the three crates 4' are filled in the loading position, since the loading is also carried out in a predetermined order. If a crate 4' is completely filled with its type of bottles 1, this crate 4' is transported away after the withdrawal of the stop 33 and replaced with an empty crate 4'. Accordingly, a crate 4 on the first conveyor 3 is replaced with a new, full crate 4 after it has been emptied. In this fashion, crates 4' containing only one type are formed from crates 4 with unsorted bottles 1 with the least amount of space and time requirements.

The emptied crates 4 can be transported e.g. to a collection point or a crate washer by the first conveyor 3; the feeding of the second to fourth conveyors 17, 8 and 9 with the desired crate material, be it with similar crates or different crates adapted to the bottle types, can be carried out by hand.

FIG. 4 also shows another possibility. Here, the first conveyor 3 ends in the starting area of the second to fourth conveyors 17, 8, 9 and is connected with the starting areas by means of a transverse conveyor 25. All crates 4 delivered by the first conveyor 3 are pushed over onto the transverse conveyor 25 controlled by the computer 31 by means of a first slide 26. The crates 4 are then pushed alternatingly onto the second to fourth conveyors by means of three further slides 27, 28 and 29, which are again controlled by the computer 31. Thus, no manual intervention is required and the formation of the crates 4' containing only one type is carried out completely automatically.

It is also possible to automatically sort the emptied crates 4, e.g. by means of a sensor 30 mounted in the end area of the first conveyor 3, which responds to specific properties of the different types of crates 4 and transmits corresponding signals to the computer 31. The transfer of the crates 4 to the second to fourth conveyors 17, 8, 9 is then not carried out according to a predetermined order, but in accordance with the type allocation by individual activation of the slides 27, 28 and 29. If one type of crate should run out, since no corresponding crates are re-supplied, possibly missing crates 4' must be manually placed on the second to fourth conveyors. This placing, as well, can be automated, e.g. by vertical crate magazines above the starting areas of the second to fourth conveyors 17, 8, 9.

In addition to or instead of illumination means 23 and camera 24, a test device 11 according to FIGS. 1 and 3 can be used in the system according to FIGS. 4 to 5. Several robots 18 can also be used, which are allocated to one type each in order to increase the output or reduce the clock times. It is also possible to advance the second to third conveyors at right angles and abutting to the first conveyor in order to reduce the distance that has to be covered to the the crates. The first conveyor can also be disposed between the second to fourth conveyors. Moreover, it can be suitable to shortly deposit the bottle 1 on a surface during the testing between camera 24 and illumination means 23 and to lift the gripping bell 16. Due to this, the height of the bottle bottom is exactly defined and the bottle contour is completely accessible.

Bottles with only partly corresponding features, e.g. bottles of the same colour, but of different height, are understood to be "types" within the purview of the invention. In a device with several robots disposed one behind the other, the first robot can sort the bottles according to the colour, the second robot can sort them according to the height and the third robot can sort them according to the criterion "permanent label present or not present".

Due to the direct, controlled transfer of the bottles to be sorted from crate to crate without buffering, a compact construction of the sorting system and an operationally reliable function results in all cases.

I claim:

1. A method for sorting bottles of different types stored unsorted in crates, said method comprising delivering crates containing unsorted bottles to a sorting station, at least partially removing the bottles from a crate at said sorting station and identifying each of said bottles while removed therefrom according to type and transferring at least one identified type of bottle out of said crate at the sorting station to at least one other crate without intermediate storage.

2. The method of claim 1, wherein all of the bottles received at the sorting station are completely removed from the crate, identified, and transferred to other crates according to their type.

3. The method of claim 2, wherein all of the bottles are removed from said crate at said sorting station one after the other, identified and transferred individually into another crate according to their type.

4. The method of claim 3, wherein the bottles are gripped and lifted one at a time out of the crate at the sorting stations, guided past an identifying means and inserted down into another crate according to their type.

5. The method of claim 2, wherein crates emptied of bottles at the sorting station are returned for receiving the sorted bottles.

6. The method of claim 1, wherein the unsorted bottles are all simultaneously partially removed from said crate at said sorting station, identified and reinserted back into said crate, said crate then being transferred to an unloading station and thereafter transferring at least one identified type of bottle out of said crate at the unloading station into said at least one other crate.

7. The method of claim 6, wherein bottles of one type other than said transferred type remain in said crate at said unloading station.

8. The method of claim 6, wherein all of the bottles in the crate at the unloading station are removed therefrom and transferred to other crates according to their type.

9. The method of claim 7, wherein the bottles transferred to other crates are transferred one at time from said crate at said unloading station to said other crates.

10. The method of claim 9, wherein the said one type of bottles remaining in the crate at the unloading station are thereafter transferred simultaneously from said crate to a conveyor for further processing.

11. The method of claim 6, wherein the identified bottles of all one type are first removed from the crate at the unloading station and transferred to another crate and thereafter bottles of other types are removed sequentially until said crate at the unloading station is empty.

12. An apparatus for sorting bottles of different types stored unsorted in crates comprising delivery means for delivering crates containing unsorted bottles to a sorting station, means for at least partially removing the bottles from a crate at said sorting station and identifying each of said bottles while removed therefrom according to type and transfer means for directly transferring at least one identified type of bottle out of said crate at the sorting station to at least one other crate at a receiving station.

13. The apparatus of claim 12, wherein said transfer means removes each of said bottles from said crate at said sorting station one after the other, guides the bottle past an identifying means that identifies it according to type and thereafter transfers the identified bottle into another crate at the receiving station according to its type.

14. The apparatus of claim 13, wherein the transfer means removes all bottles from the crate at the sorting station and sorts them into crates according to their type at the receiving station.

15. The apparatus of claim 13, wherein the transfer means grips the bottles one at a time in a crate at the sorting station, lifts the bottle out of the crate and guides it past the identifying means and thereafter inserts the identified bottle down into an appropriate crate at the receiving station according to its type.

16. The apparatus of claim 14, including conveyor means for returning an empty crate from said sorting station to said receiving station to be refilled with sorted bottles.

17. The apparatus of claim 12, wherein the removing means simultaneously partially removes all of said unsorted bottles out of said crate at said sorting station for identification by said identifying means and thereafter reinserts said identified bottles back into said crate, said delivery means thereafter transferring said crate to an unloading station and said transfer means thereafter directly transferring at least one identified type of bottle to said at least one other crate at said receiving station.

18. The apparatus of claim 17, including additional transfer means for simultaneously transferring at least one other type of identified bottle in said crate at said unloading station to a processing station.

19. The apparatus of claim 12, wherein said delivery means comprises a delivery conveyor and said apparatus includes a plurality of receiving conveyors at said receiving station adapted to hold a plurality of crates to be filled by the transfer means with sorted bottles removed from the crate at the sorting station.

20. The apparatus of claim 19, including drive means for driving said conveyors and control means for operating said conveyors at the receiving station to bring an empty crate into position for receipt of bottles from the transfer means and for removing a crate from said position after it has been filled with bottles.

21. The apparatus of claim 20, wherein the delivery conveyor and the receiving conveyors are adjacent to and parallel to one another.

22. The apparatus of claim 21, wherein the delivery conveyor moves in one direction and the receiving conveyors in the opposite direction.

23. The apparatus of claim 22, including a driven recycling conveyor controlled by the control means for receiving empty crates from the delivery conveyor and returning them to the receiving conveyors.

* * * * *